US006835113B1

(12) United States Patent
Hsu

(10) Patent No.: US 6,835,113 B1
(45) Date of Patent: Dec. 28, 2004

(54) STRUCTURE OF A DECORATIVE ARTICLE

(76) Inventor: Lieh-Liang Hsu, 1F, No. 14, Alley 47, Lane 115, Sec. 2, Chenggong Rd., Neihu District, Taipei City, 114 (TW)

( * ) Notice: Subject to any disclaimer, the term of this patent is extended or adjusted under 35 U.S.C. 154(b) by 0 days.

(21) Appl. No.: 10/622,635

(22) Filed: Jul. 21, 2003

(51) Int. Cl.[7] ..... A63H 3/36; A63H 3/00; G09F 19/08

(52) U.S. Cl. ..... 446/320; 446/487; 40/411

(58) Field of Search ..... 446/487, 489, 446/353, 331, 268, 320, 367, 366, 365, 352, 484, 314, 330, 378; 40/411, 414, 417, 409, 415, 421, 423

(56) References Cited

U.S. PATENT DOCUMENTS 4,992,072 A * 2/1991 Leigh ..... 446/486
6,135,848 A * 10/2000 Hou ..... 446/353
6,190,230 B1 * 2/2001 Hou ..... 446/355
6,491,567 B2 * 12/2002 Chan ..... 446/478
6,572,432 B1 * 6/2003 Tsai ..... 446/320
6,764,375 B1 * 7/2004 Hsu ..... 446/236
2002/0100195 A1 * 8/2002 Hsu ..... 40/409

* cited by examiner

*Primary Examiner*—Jacob K. Ackun
*Assistant Examiner*—Faye Francis
(74) *Attorney, Agent, or Firm*—Rosenberg, Klein & Lee

(57) ABSTRACT

A structure of a decorative article including a base device, a motor, a guiding device and a transmission device is disclosed. The motor including a driving shaft is mounted on the base device. The guiding device including a guiding means with a guiding track is mounted on the base device. The transmission device includes a sliding plate with a hole, a transmission shaft with a disk wheel eccentrically formed on the end, a linking bar connected to the sliding plate and a gear set, the disk wheel being located in the hole so that the sliding plate is slidably moved in the guiding track when the transmission shaft is driven by the motor through the transmission of the gear set. It provides a smooth transmission with lower friction to obtain a stable structure having longer lifetime and higher quality.

10 Claims, 8 Drawing Sheets

STRUCTURE OF A DECORATIVE ARTICLE

BACKGROUND OF THE INVENTION

1. Field of the Invention

The present invention relates generally to a structure of a decorative article and, more particularly, to a stable structure with smooth transmission and lower friction for a decorative article.

2. Description of the Related Art

Most of the decorative articles are static. However, a well-known dynamic decorative article is more popular recently. The structure of the dynamic decorative article includes a transmission mechanism to drive a movable portion of the dynamic decorative. For example, a decorative eagle provides a dynamic effect of the flapping wings. This kind of dynamic effect can make the decorative article more valuable.

However, the convention structure of the decorative article does not have good and smooth transmission mechanism. It needs improvement to provide a stable structure with longer lifetime and higher quality for a decorative article.

BRIEF SUMMARY OF THE INVENTION

To achieve these and other advantages and in order to overcome the disadvantages of the conventional method in accordance with the purpose of the invention as embodied and broadly described herein, the present invention provides a structure of a decorative article with a smooth transmission and lower friction so that a stable structure with longer lifetime and higher quality can be obtained.

The other object of the present invention is to provide a dedicate structure for a decorative article with dynamic performance.

According to the above-mentioned objects, the structure of a decorative article includes a base device, a motor, a guiding device and a transmission device. The motor including a driving shaft is mounted on the base device. The guiding device including a guiding means with a guiding track is mounted on the base device. The transmission device includes a sliding plate with a hole, a transmission shaft with a disk wheel, a linking bar connected to the sliding plate and a gear set, the disk wheel being located in the hole so that the sliding plate is slidably moved in the guiding track when the transmission shaft is driven by the motor through the transmission of the gear set.

According to the structure of the present invention, the base device comprises a casing mounted on a base plate, and a hollow column is formed on the casing. The structure further comprises a decorative housing with a movable portion to be connected with the linking bar. The linking bar includes a connecting portion such as a hook on the top end thereof.

According to the structure of the present invention, the guiding device further comprises a supporting means to support the transmission shaft. The guiding means and the supporting means include two pairs of guiding stands and two supporting elements located on two opposite sides of the base plate, respectively.

According to the structure of the present invention, the disk wheel is eccentrically connected on one end of the transmission shaft, and the hole of the sliding plate is an oval hole. The gear set includes a motor gear mounted on the driving shaft of the motor, and a transmission gear mounted on the transmission shaft. The gear set can further include an intermediate gear to engage with the motor gear and transmission gear.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE INVENTION

Figure 1:
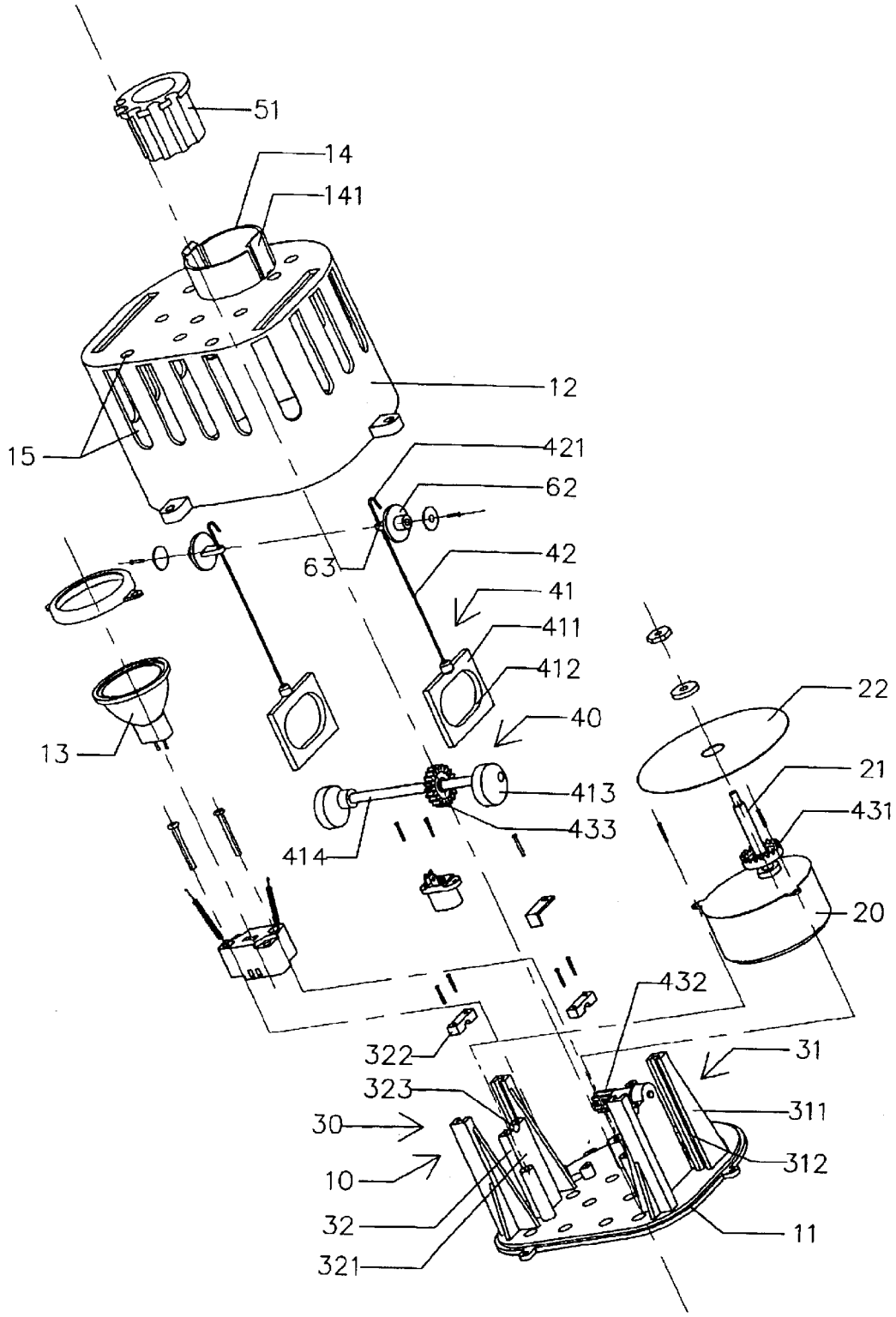
FIG. 1 is an exploded view illustrating the structure of a decorative article according to a preferred embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Refer to FIGS. 1–5, the structure of a decorative article according to the present invention includes a base device 10, a motor 20, a guiding device 30 and a transmission device 40. The base device 10 further includes a base plate 11 and a casing 12. There is a light source 13' located on the base plate 11. The casing 12 is mounted to the base plate 11 by screws to provide a containing space. A hollow column 14 is formed on the casing 12 to engage a bushing 51. The bushing 51 can be fixedly engaged with the hollow column 14 through an engaging means 141 formed on the circumferential surface of the hollow column 14. The bushing 51 is used to connect a decorative housing as will be described in detail hereinafter. Furthermore, the casing 12 includes a plurality of holes 15 for conducting the light emission and reducing the material stuff. The motor 12 is mounted on the base plate 11 and has a driving shaft 21. The top end of the driving shaft 21 is connected with a transparent color plate 22 which is located above the light source 13. The transparent color plate 22 includes different colored portions and is rotated by the driving shaft 21. Therefore, when the light source 13 emits light toward the rotating transparent color plate 14, a colorfully lighting effect can be achieved. Besides, a speaker (not shown) can be mounted on the base plate 11 to provide music and sound.

The guiding device 30 includes a guiding means 31 is furnished on, or integrally formed with the base plate 11. The guiding means 31 has two pairs of guiding stands 311 located on two opposite sides of the base plate 11, respectively. Each guiding stand 311 has a sliding slot 312. Two corresponding sliding slots 312 of the pair of the guiding stands 311 forms a guiding track. Next, a supporting means including two supporting element 32 is located between two pairs of the guiding means 31. Each supporting element 32 including a seat portion 321 and a cover portion 322 is adjacent to each respective pair of guiding stands 311. The cover portion 322 is fixed on the seat portion 321 by screws to form an axial hole 323. However, in another preferred embodiment, the supporting element 32 may be integrally formed with the axial hole 323.

Figure 6:
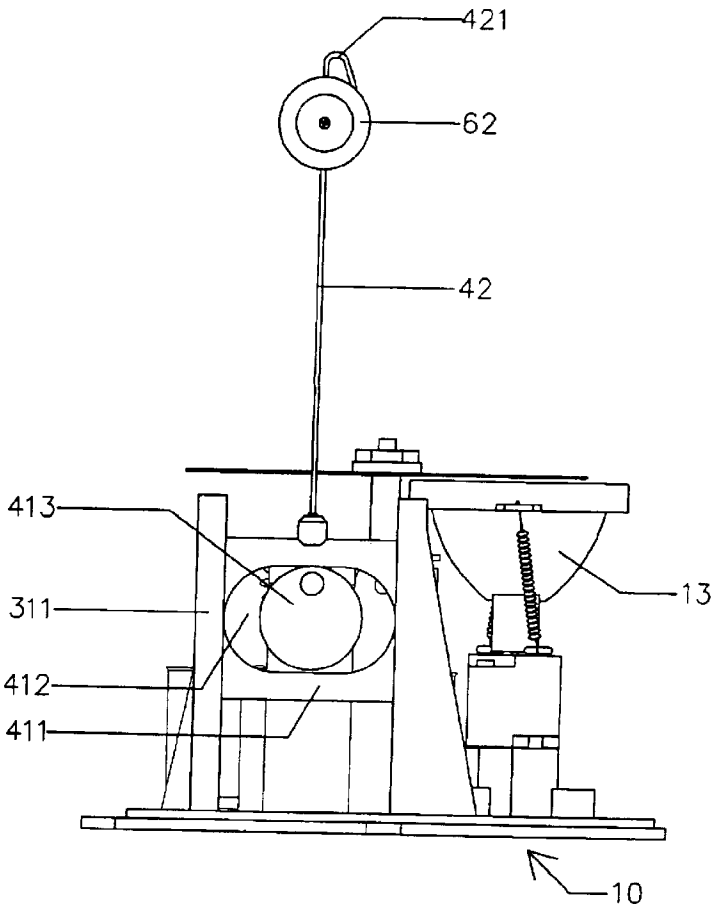
FIG. 6 is a side view of a partial combined structure showing the sliding plate at a second position.
Figure 2:
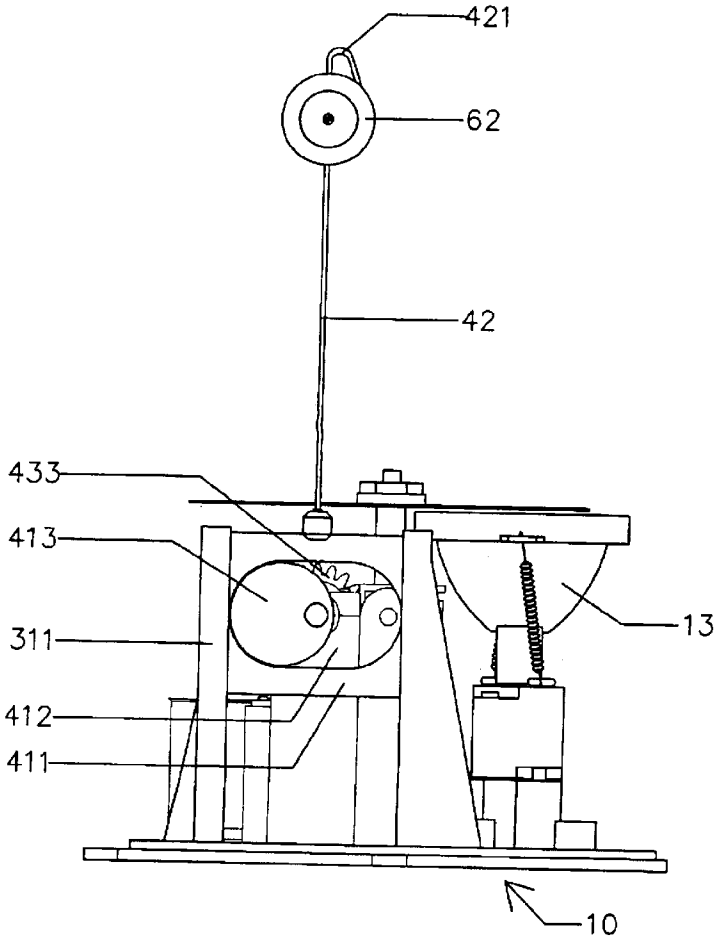
FIG. 2 is a side view of a partial combined structure showing a sliding plate at a first position.
Figure 4:
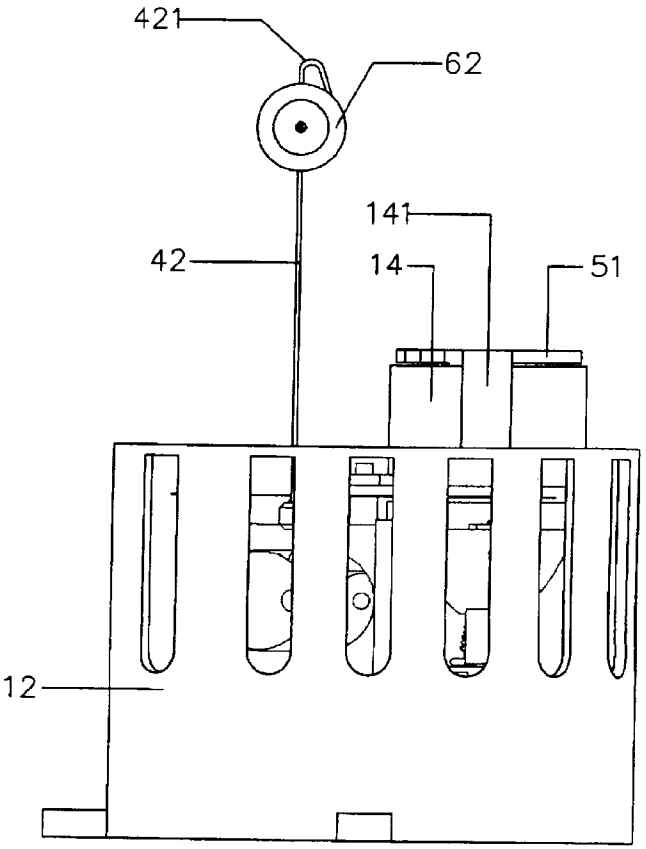
FIG. 4 is a side view of the combined structure according to the preferred embodiment.
Figure 3:
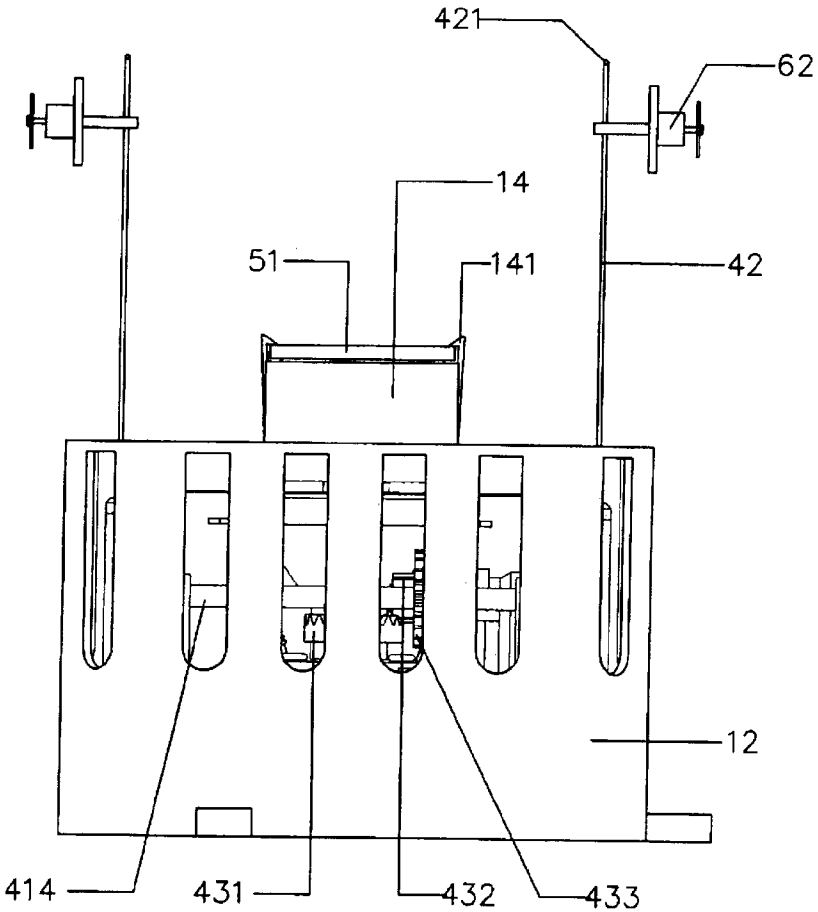
FIG. 3 is a front view of the combined structure according to the preferred embodiment.
Figure 5:
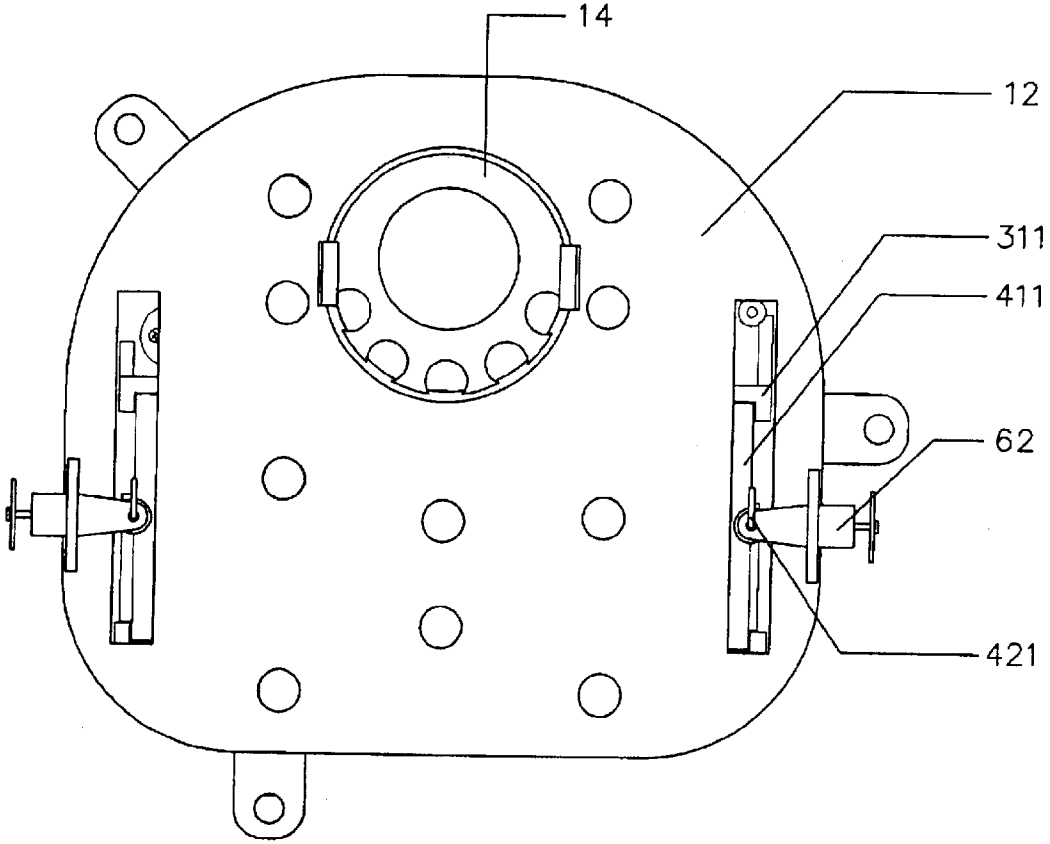
FIG. 5 a top view of the combined structure according to the preferred embodiment.

The transmission device 40 includes a sliding means 41, two linking bars 42 and a gear set. The sliding means 41 includes two sliding plates 411 and a transmission shaft 414. Each sliding plate 411 with an oval hole 412 is slideably mounted in two corresponding sliding slots 312 of each pair of guiding stands 31. There is a disk wheel 413 eccentrically formed on each end of the transmission shaft 414. The transmission shaft 414 is penetrated into two axial holes 323 to be supported by two supporting element 32 of the supporting means. Each disk wheel 413 is then located in the oval hole 412 of each sliding plate 411. The linking bar 42 is connected to the sliding plate 411 on one end, and is formed a connecting portion such as a hook 421 on the other top end. The gear set includes a motor gear 431, an intermediate gear 432 and transmission gear 433. The motor gear 431 is mounted on the driving shaft 21 of the motor 20. The intermediate gear 432 is furnished on one of the seat portion 321 of the supporting element 32 to engage with the motor gear 431. The transmission gear 433 is located on the transmission shaft 414 to engage with the intermediate gear 432. Therefore, the transmission shaft 414 is driven by the motor 20 to rotate the disk wheels 413 along the oval holes 412 of the sliding plates 411. Because the disk wheel 413 is not centrally connected to the transmission shaft 414, the rotation of the wheel 413 will make the sliding plate 411 siding in the guiding track formed by two corresponding sliding slots 312 of each pair of the guiding stands 311, from a first position to a second position as shown in FIG. 2 and FIG. 6. Nevertheless, the intermediate gear 432 is for connection and transmission between the motor gear 431 and the transmission gear 433, in another arrangement in the other preferred embodiment, the intermediate gear 432 may be omitted from the gear set as long as the transmission shaft 414 can be driven by the motor 20 through the gear set.

Figure 7:
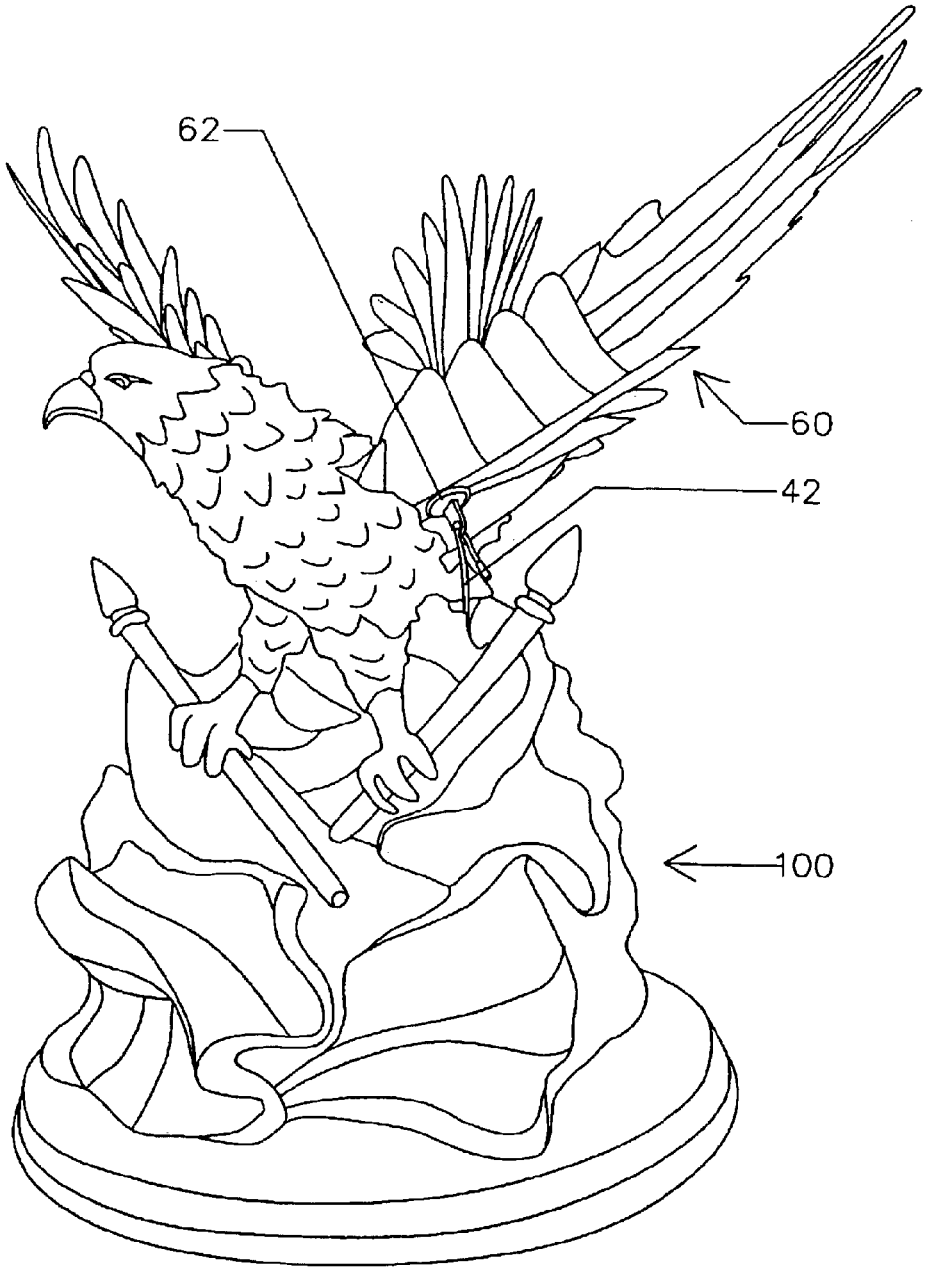
FIG. 7 is a perspective view illustrating the decorative article according the preferred embodiment.
Figure 8:
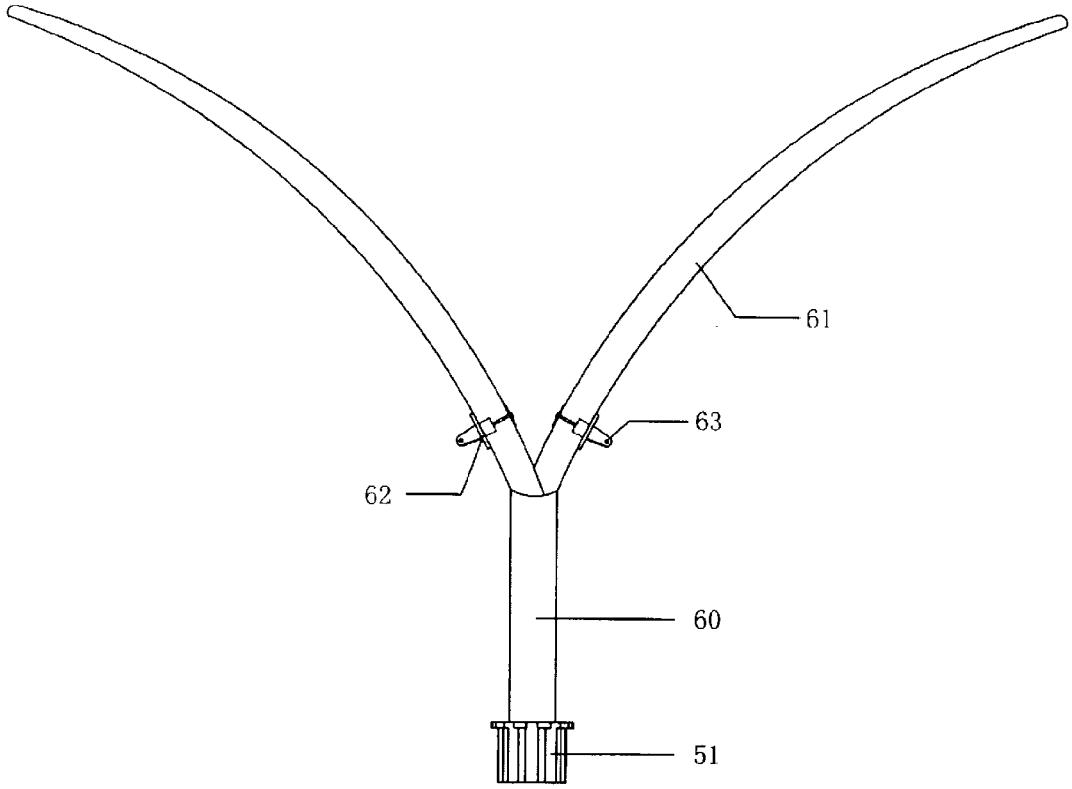
FIG. 8 is a connecting structure of the decorative article according to the preferred embodiment.
Figure 9:
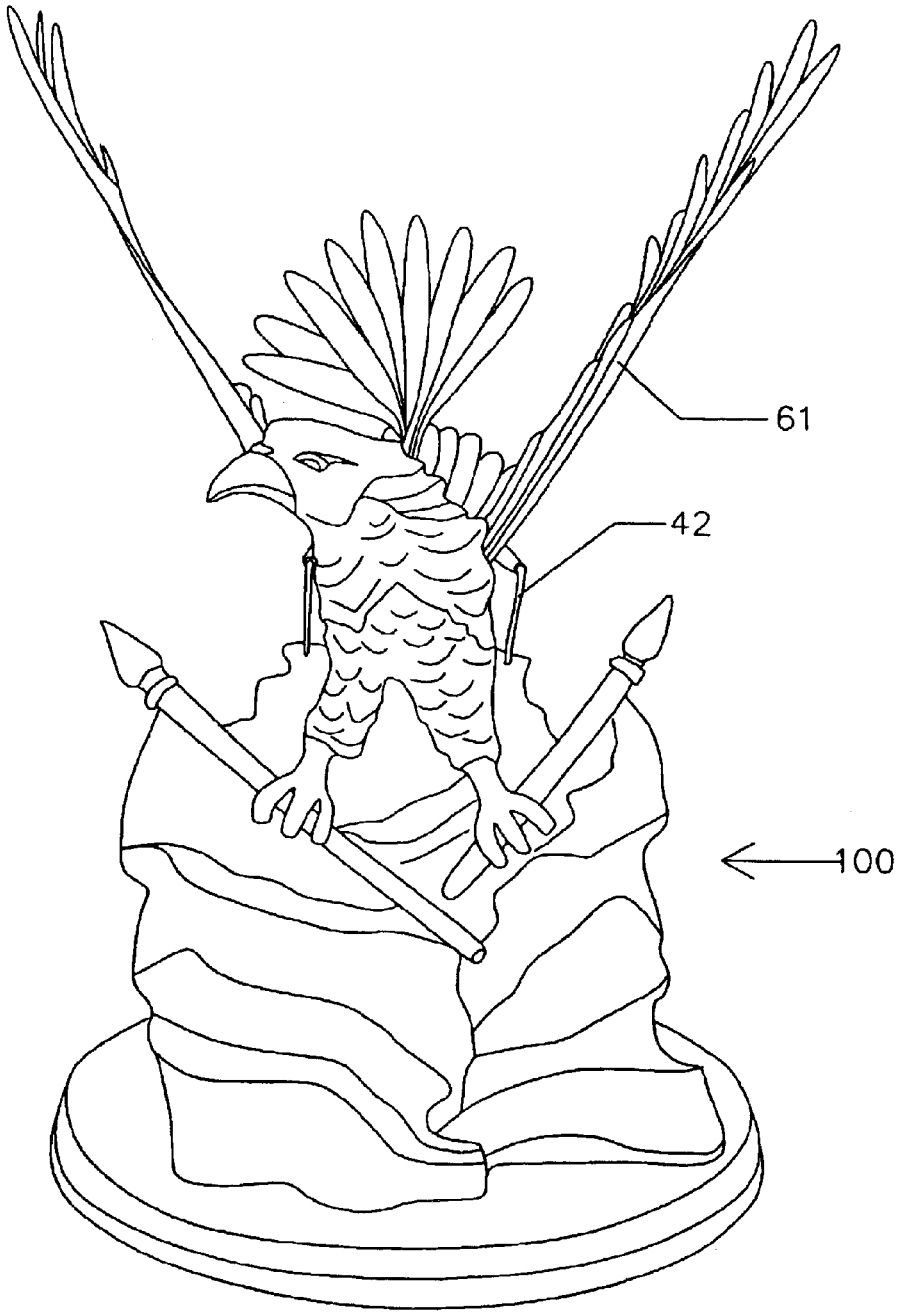
FIG. 9 is a first status of the decorative article according to FIG. 2.
Figure 10:
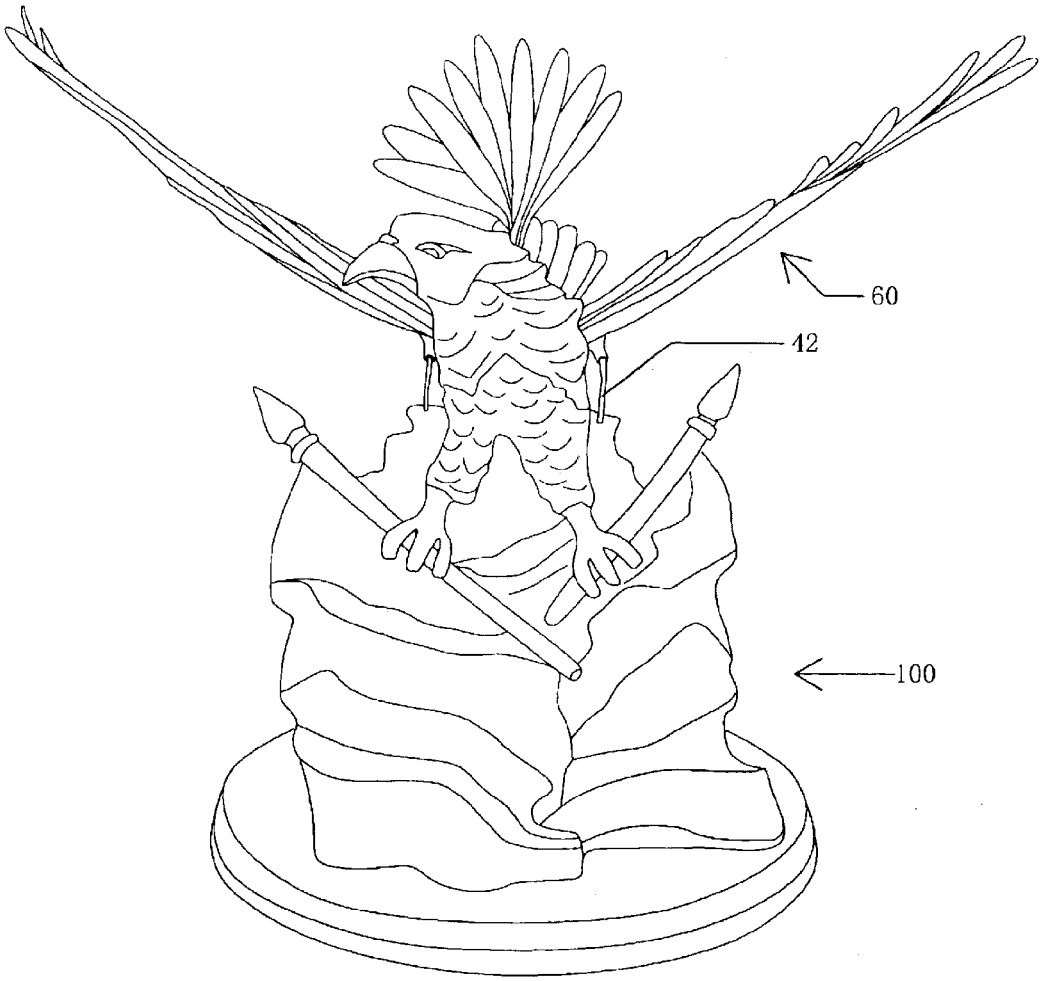
FIG. 10 is a second status of the decorative article according to FIG. 6.

FIGS. 7 and 8 show a decorative eagle 100 as an application in the present invention and the connecting structure thereof. The eagle 100 has two wings 60. The frame 61 of the wings 60 is connected to the bushing 51 fixedly mounted with the column 14 of the casing 12. There are two positioning elements 62 formed on the frame 61. A fixing hole 63 formed on each positioning element 62 is caught by the hook 421 of the linking bar 42. According to the above description, the reciprocation of the sliding plates 411 moves the linking bars 42 to pull down and return the frame 61 as shown in FIG. 10 and FIG. 9, respectively.

In this preferred embodiment, two linking bars 42 are consistently moving up and down to provide the dynamic flapping wings of the eagle 100. However, under a different arrange ment of the disk wheel in the oval hole 412 of the sliding plate 411, it can make two linking bars move up and down in different phases to provide another dynamic performance in different decorative article.

Due to the dedicate structure of the present invention, the transmission is smooth and with lower friction; therefore, it provides a stable structure of a decorative article to have a longer lifetime and higher quality.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent. It provides a smooth transmission with lower friction so that a stable structure with a longer lifetime and higher quality is achieved.

What is claimed is:

1. A structure of a decorative article, comprising:

a base device;

a motor including a driving shaft, being mounted on the base device;

a guiding device including a guiding means with a guiding track, being mounted on the base device; and a transmission device including a sliding plate with a hole, a transmission shaft with a disk wheel, a linking bar connected to the sliding plate and a gear set, the disk wheel being located in the hole so that the sliding plate is slidably moved in the guiding track when the transmission shaft is driven by the motor through the transmission of the gear set.

2. The structure of claim 1 wherein the base device comprises a casing mounted on a base plate, and a hollow column is formed on the casing.

3. The structure of claim 1 wherein the guiding device further comprises a supporting means to support the transmission shaft.

4. The structure of claim 3 wherein the guiding means and the supporting means include two pairs of guiding stands and two supporting elements located on two opposite sides of the base plate, respectively.

5. The structure of claim 1 wherein the disk wheel is eccentrically connected on one end of the transmission shaft, and the hole of the sliding plate is an oval hole.

6. The structure of claim 1 wherein the linking bar includes a connecting portion on the end thereof.

7. The structure of claim 6 wherein the connecting portion is a hook.

8. The structure of claim 1 wherein the gear set includes a motor gear mounted on the driving shaft of the motor, and a transmission gear mounted on the transmission shaft.

9. The structure of claim 8 wherein the gear set further includes an intermediate gear to engage with the motor gear and transmission gear.

10. The structure of claim 1 further comprising a decorative housing with a movable portion to be connected with the linking bar.

* * * * *